United States Patent [19]

Cody

[11] 4,118,027

[45] Oct. 3, 1978

[54] LIQUID GAME AMUSEMENT SYSTEM

[76] Inventor: William H. Cody, 1200 T-1 Westerly Pl., Baltimore, Md. 21228

[21] Appl. No.: 832,355

[22] Filed: Sep. 12, 1977

[51] Int. Cl.[2] ..... A63F 9/00

[52] U.S. Cl. ..... 273/1 L; 35/19 R

[58] Field of Search ..... 273/1 R, 1 L; 35/19 R

[56] References Cited

U.S. PATENT DOCUMENTS 3,994,492 11/1976 Breslow ..... 273/1 R

OTHER PUBLICATIONS

Every Boys Book, Routledge, 8-1881, p. 527

Schaper 1966 Game Catalog 3-1966, "The Last Straw".

*Primary Examiner*—Paul E. Shapiro

[57] ABSTRACT

A liquid game amusement system that operates under the principle that atmospheric pressure acting on a cover member will maintain a quantity of liquid contained within a container when the container is inverted. A cup-like container is filled with liquid and a planar cover member is placed contiguous to a rim portion of the container. The container and cover member are inverted and releasably secured to a vertically directed stand. The cover member has hook elements passing from a lower surface thereof. An operator spins a dial or spinner element on a game board and termination of the rotation of the spinner in a particular indicia zone of the game board determines a particular weight element to be used by the operator. The operator chooses the particular weight element and locates himself or herself under the combined container and cover member. The operator then secures the weight element to one of the cover hook elements extending from the cover. If the atmospheric pressure still produces a greater upward force on the cover member than the opposing downward gravity force of the liquid within the container, the cover remains in place and the liquid is maintained within the container. The next operator repeats the same process and eventually, the combined weight of the various weight elements and the gravity force of the liquid within the container causes the cover to be released from the rim portion of the container and the operator at that time is doused with the liquid from within the container.

10 Claims, 6 Drawing Figures

FIG. 1
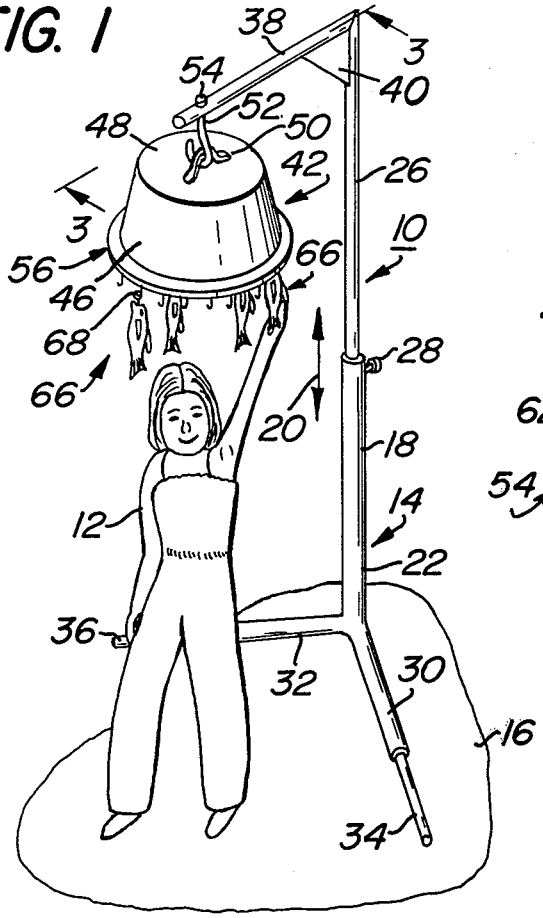
FIG. 3
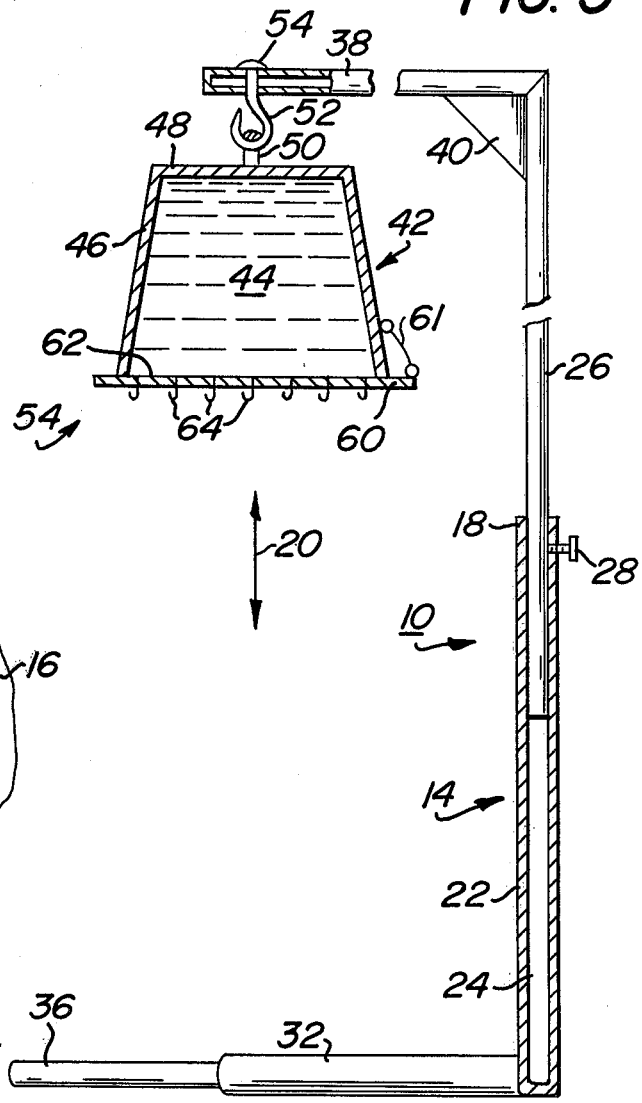
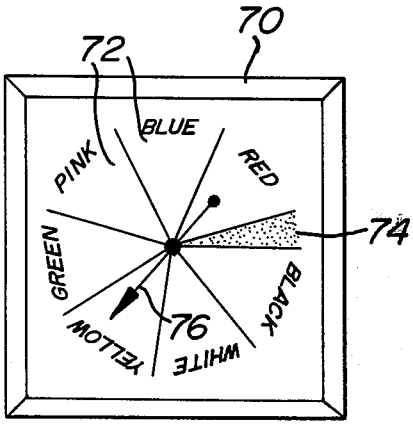
FIG. 2
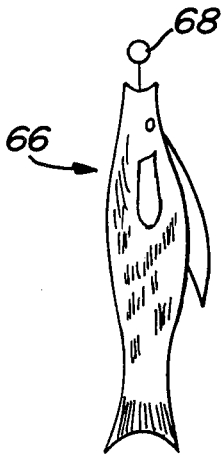
FIG. 4

LIQUID GAME AMUSEMENT SYSTEM

BACKGROUND OF THE INVENTION

1. Field of the Invention

This invention pertains to amusement devices. In particular, this invention relates to liquid game amusement systems. More in particular, this invention pertains to liquid game amusement systems which operate under the principle that a container filled with liquid and enclosed by a cover member may be inverted without egress of the internally contained liquid. Still further, this invention relates to a game system where an operator adds weights to the cover member when the cover member and the container are in an inverted position until the weighted elements and the liquid within the container cause a sufficient force in a downward direction to expel the liquid within the container. More in particular, this invention relates to a liquid game amusement system which incorporates a chance probability of the user being doused with liquid.

2. Prior Art

Chance games utilizing the concept of the removal of members or the particular placement of members until the object of the game is reached are known in the art. However, such prior art games do not generally utilize the principle of a weight of liquid opposing atmospheric pressure until the operator is doused with liquid within a container. In some prior art devices such as that shown in U.S. Pat. No. 3,994,492 elements such as jaws are spring loaded through a rubber band system. Objects are loaded into the jaws to maintain them in an open position. Game objects are then removed until at some point the jaws are snapped into a closed position. Such references do show game like devices which utilize the concept of the removal of weight members until some predetermined point when the lack of the weight of the object members causes a reaction of the jaws. However, such game devices do not provide for the release of liquid overcoming atmospheric pressures subsequent to an operator placing a predetermined number of weights on the cover member of a container.

In other prior art references such as U.S. Pat. No. 3,559,989 there is shown various water balancing game systems. In such references floating members are placed in water and a pointer is spun to indicate a predetermined location on the deck of the floating member upon which an object piece is to be placed. When an imbalance is shown, the pieces or the floating member is tilted into the surrounding water. Such prior art systems do not utilize atmospheric pressures to maintain liquid within an enclosed volume and still further the results of the final actuation of the floating object is merely a removal of the pieces from the floating member.

Other prior art systems such as that shown in U.S. Pat. No. 3,589,723 provide for other types of balancing systems. However such prior art devices and systems are not directed to the elements of the capturing of liquid within an enclosed chamber and subsequently release of the liquid responsive to playing pieces being hooked onto a cover member.

SUMMARY OF THE INVENTION

A liquid game amusement system which comprises a stand memberadapted to be mounted on a base surface. A container mechanism is releasably securable to the stand member and is adapted to contain a liquid inserted therein. A cover is mounted to a rim portion of the container mechanism in a manner such that the liquid is maintained within the container by atmospheric pressure acting on a lower surface of the cover. Further, weight mechanisms are releasably securable to the cover mechanism external to the container for purposes of counter-acting the atmospheric pressure forces on the lower surface of the cover.

BRIEF DESCRIPTION OF THE DRAWINGS

FIG. 1 is a perspective view of the liquid game amusement system;

FIG. 2 is a plane view of the game board utilized in the liquid game amusement system;

FIG. 3 is a sectional view of the liquid game amusement system taken along the section lines 3—3 of FIG. 1;

FIG. 4 is an elevational view of a weight element utilized in the liquid game amusement system;

DESCRIPTION OF THE PREFERRED EMBODIMENTS

Figure 5:
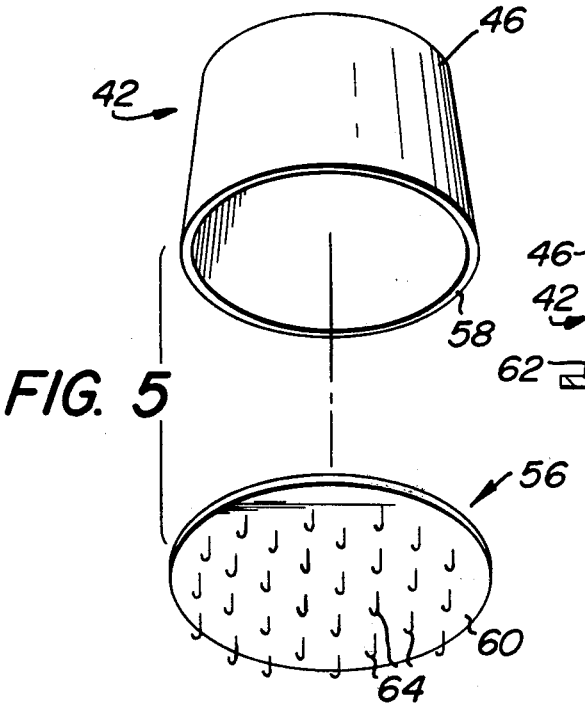
FIG. 5 is a perspective exploded view of the container and cover member used in the liquid game amusement system; and, FIG. 6 is an elevational view partially cut away of an embodiment of the liquid game amusement system.

Referring now to FIGS. 1–5 there is shown liquid game amusement system 10 for the specific purposes of enjoyment and amusement by operators in the playing of a game. In overall concept, amusement system 10 relies on the principle that a container or other vessel may be filled with a liquid medium and the vessel may be covered with a planar member. The liquid medium remains confined within the vessel even when the container is inverted. This occurs due to the fact that the weight of the liquid medium is providing a first force on the cover to remove it from the container. However, opposing the weight force of the liquid medium, there is an atmospheric pressure force acting to maintain the cover on the container. By adding weights to the container in the direction of the gravity forces of the liquid medium, there comes a point when the cover is removed from the vessel and the liquid medium egresses in a vertically downward direction.

Amusement system 10 includes stand member 14 which is adapted to be mounted on a base surface 16 as shown in FIG. 1. Amusement system 10 is generally played in an external or outdoor environment and is specifically directed to a game system generally played near a pool or other source of liquid, such as water, however, the inventive concept as is herein defined and described is not restrictive of the environment within which amusement system 10 is to be applied and/or utilized.

Stand member 14 includes vertical extension mechanism 18 which is extendable in a vertical direction defined by vertically directed arrow 20. Vertical extension mechanism 18 provides for a vertically adjustable system 10 and may be of the telescoping type as will be defined in the following paragraphs. Vertical extension mechanism 18 may include lower tubular rod member 22 having a vertically directed passage 24 of a predetermined diameter. Vertical extension mechanism 18 further may include upper tubular rod member 26 having a diameter substantially equal to but slightly less than the diameter of passage 24. In this manner, upper tubular rod member 26 may be displaced in a vertical direction 20 within lower rod member 22.

Vertical adjustment mechanism 28 defines a device for vertically adjusting the various components of vertical extension mechanism 18. Adjustment mechanism 28 may be a set screw passing through an opening formed in a lateral side wall of lower tubular rod member 22 and contacting upper tubular rod member 26 as is clearly seen in FIG. 3. Thus, upper tubular rod member 26 may be moved to a predetermined height with respect to lower tubular rod member 22. Once this is accomplished, set screw or vertical adjustment mechanism 28 may be threadedly engaged with the lateral wall of lower tubular rod member 22 and forced into contact with upper rod member 26 to place rod members 26 and 22 in locking engagement with respect to each other.

Stand member 14 is mounted to base surface 16 through a pair of base leg members 30 and 32 as shown in FIG. 1. Base leg members 30 and 32 may be secured to lower rod member 22 by bolts, screws, welding, or some like technique. Alternately, leg members 30 and 32 may be formed in one piece of formation with lower rod member 22, however, the method and mode of securement is not important to the inventive concept as is herein described. The important concept being that leg members 30 and 32 are formed in an orthogonal manner with respect to lower rod member 22 in order that when legs 30 and 32 are mounted on base surface 16, that rod member 22 is extended in a vertical direction 20. Each of base leg members 30 and 32 may also include base telescoping members 34 and 36 which are insertable within tubular passages formed in leg members 30 and 32 in the manner that upper rod member 26 passes within lower tubular rod member 22. In this manner, a more secure mounting for stand member 14 may be acquired on base surface 16 when telescoping members 34 and 36 are extended with respect to their base leg members 30 and 32. The telescoping aspect of base leg members 30 and 32 allows for amusement system 10 to remain in a compact package prior to the use by operators 12.

Stand member 14 includes horizontal bar 38 passing in a perpendicular or normal direction to upper tubular rod member 26. Bar 38 is secured through bolting, welding, or some like means not important to the invention, to the upper section of rod member 26 as is clearly shown in FIGS. 1 and 3. For structural considerations, wedge element 40 may be secured to bars 38 and rod member 26 in order to relieve some of the cantilever type stresses imposed on stand member 14. Thus, as has here-in been described, horizontal bar 38 may be vertically adjusted above base surface 16 in a manner adaptable to a wide variety of sizes of operators 12. In this manner, amusement system 10 may be utilized by children or adults with simple adjustment of stand member 14.

Stand member 14 component elements may be formed of a metal such as aluminum or stainless steel or some like material not important to the concept as is herein described. The only consideration being that the metal chosen for stand member 14 elements be of sufficient structural integrity to maintain the force loads being applied.

Amusement system 10 includes container 42 which is releasably secured to stand member 14 when amusement system 10 is in operation. Container 42 is adapted to contain liquid 44 inserted therein. In general, when amusement system 10 is being used in an external environment, liquid 44 may be water. Container 42 is generally cup-like in overall contour and includes lateral side walls 46 joined in one piece formation to base surface 48 as is shown in FIGS. 1 and 3. In general, container base 48 is planar in contour in order that the internal environs of container 42 may be completely filled with liquid 44.

Lug member 50 is fixedly secured to container base 48 through rivets, bolts, or some like mechanism. As will be discussed in following paragraphs, system 10 includes cover device 56 which may be releasably constrained to container 42 by cord member 61. Cord member 61 is utilized in order that user 12 will not be impacted by cover device 56 when liquid 44 egresses from container 42.

Horizontal bar 38 includes horizontal bar hook 52 which is secured to horizontal bar 38 through an extended bolt head 54 or some like means. In this manner, container 42 is releasably securable to stand member 14. Thus, lug member 50 may be inserted over horizontal bar hook 42 in order to maintain container 42 in an inverted position or location when filled with liquid 44 in the manner to be described in the following paragraphs.

Amusement system 10 includes cover device 56 which is mounted to rim portion 58 of container 42 shown in FIG. 5. As is evident, cover device 56 is mounted to container 42 in a manner such that liquid 44 is maintained within container 42 by means of atmospheric pressure acting on lower surface 60 of the cover device 56. Thus, when cover device 56 is positionally located as shown in FIGS. 1 and 3, the weight of liquid 44 which substantially fully fills the internal cavity of container 42 acts on cover device upper surface 62. In opposition, the atmospheric pressure of the external environment acts on cover device lower surface 60 in a manner opposing the weight of liquid 44 within a container 42. When the atmospheric pressure acting in an upward vertical direction 20 is greater than the weight of the downwardly directed force imposed by liquid 44, cover device 56 is maintained in a fixed relation to rim portion 58 of container 42. In general, cover device 56 may be circular or have another type of contour, however, cover 56 should in general be planar in nature in order to contiguously interface with rim portion 58 throughout the closed contour formed by rim 58. Additionally, rim 58 should be substantially planar in nature in order to allow a contiguous interface with cover device upper or internal surface 62. In this manner, liquid 44 will not seep out of the internal cavity provided by container 42.

Extending from cover device lower surface 60, there is as shown a plurality of cover hook members 64 to provide releasable securement for elements to be described in the following paragraphs. Cover hook members 64 may be secured to cover 56 by threaded engagement or some like fixed securement method not important to the inventive concept as is herein described. As is seen in FIG. 5, cover hook member 64 may be placed in a number of locations throughout the extension of cover device 56. The positioning of hook members 64 will provide different moments and force effects to be applied to cover device 56 at the discretion of operators 12 when playing with game amusement system 10.

Amusement system 10 further includes a multiplicity of weighted elements 66, one of which is shown in FIG. 4. Weight elements 66 are releasably securable to cover device 56 by interface with cover hook members 64 in such a manner that weight elements 66 may be mounted to cover device 56 external to container 42 as is shown in FIG. 1. Each of the weight elements may include an eyelet member 68 which is adapted to be inserted on one of cover hook members 64. Each of weight elements 66 may have a particular contour, such as that shown of a fish, however, the particular contour is not important to the inventive concept as is herein described. Additionally and for purposes to be described in the following paragraphs, each weight element 66 may have a particular indicia formed thereon, or may be of a particular color in order that operator 12 will be able to distinguish between various weight elements 66 which are utilized within the playing of amusement system 10. Further, each of weight elements 66 may have a particular weight generally different than other weight elements 66 utilized in the amusement system 10.

As shown in FIG. 2, amusement system 10 utilizes game board member 70 which includes a plurality of indicia zones 72. Each of zones 72 are shown in particular reference through a predetermined color which would generally correspond to a color of one of weight elements 66. Indicia zone 74 corresponds to a particular area where operator 12 would not have to place a particular weight element 66 on cover device 56. Spinner 76 is rotatably secured to game board 70 in a manner well known in the art. Operator 12 spins or rotates a spinner member 76 and when the arrow portion of 76 points in a particular indicia zone 72 or 74, such indicates which of the weight elements 66 corresponding to the particular color or other type of reference the operator must place on cover hook members 64.

In operation, and as an indication of how amusement system 10 is played, operators 12 initially fill container 42 with liquid 44. Cover member of device 56 is contiguously placed over rim portion 58 of container. Container 42 is then inverted and placed over horizontal bar hook 52. Atmospheric pressure acting in an upward vertical direction 20 opposes the gravity weight of liquid 44 within container 42 and maintains cover 56 in securement with rim portion 58 in order to maintain liquid 44 within container 42. Operator 12 then rotates spinner 76 on game board 70. Spinner 76 subsequent to termination of rotational displacement stops in a particular indicia zone 72 or 74. Indicia zones 72 determine the particular weight element 66 that the operator who rotated the spinner 76 must place on cover hook members 64. Operator 12 then chooses the particular weight element 66 and stands under container 42 as is shown in FIG. 1. Operator 12 places eyelet member 68 over one of cover hook members 64. If the predetermined weight of the chosen or particular weight element 66 is not sufficient to overcome atmospheric pressures, cover device 56 remains in contiguous contact with rim portion 58 and liquid 44 maintains its position within container 42. The game continues until one of operators 12 upon placement of a particular weight element 66 causes the total force on cover device 56 to overcome atmospheric pressures acting on lower surface 60. At this time, the operator is doused with liquid of 44 passing external to container 42.

As is evident, container 42 and cover device 56 should be formed of a material which is impermeable to liquid 44, however, such material should have a low density. In general, plastic material has been used successfully however, such is not important to the inventive concept as is herein defined and described.

Figure 6:
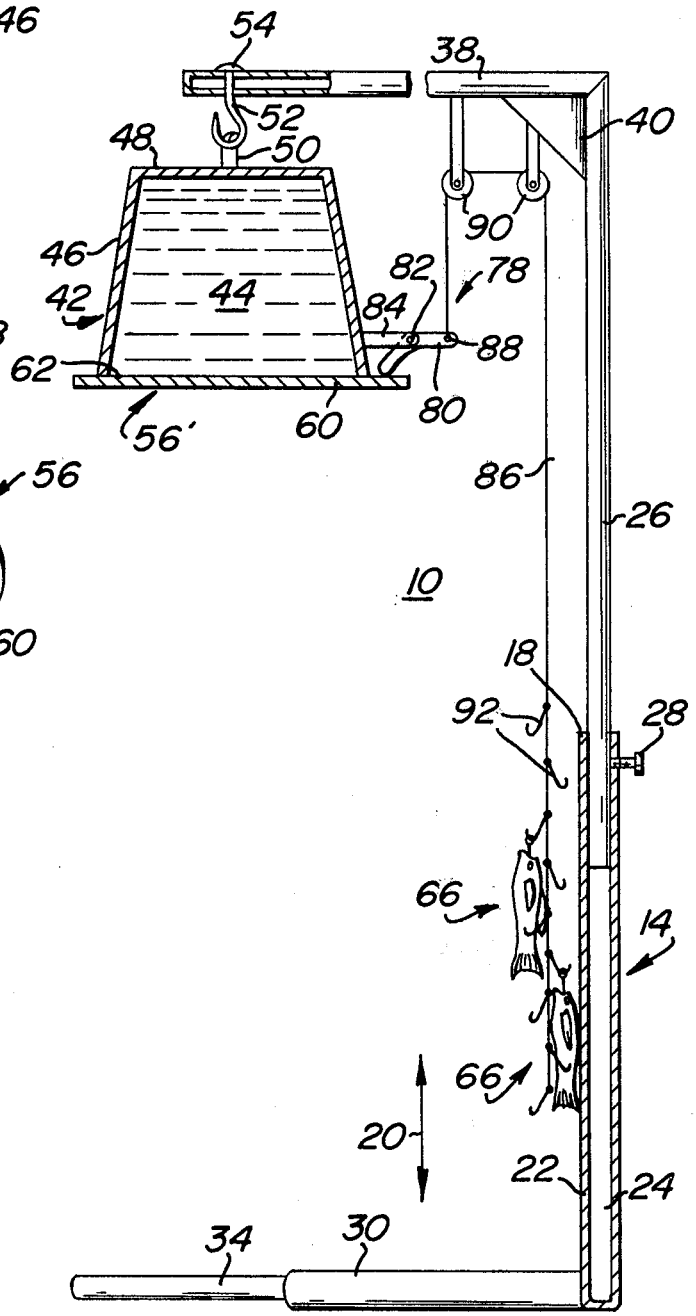

An embodiment of amusement system 10 is shown in FIG. 6. Amusement system 10' as shown in FIG. 6 includes weight securing mechanism 78 which is pivotally connected to cover 56' and is a linearally displaceable with respect to stand member 14. Weight securing mechanism 78 includes pivot link member 80 which is pivoted at a pivot point 82 to extension bar 84 which in itself is mounted in fixed securement to lateral side walls 46 of container 42. Thus, pivot link 80 may rotate with respect to extension bar 84 about pivot point 82. Pivot link member 80 is secured to cover 56' as is shown, through welding, bolting, or some like mechanism not important to the inventive concept. Additionally, weight securing mechanism 78 includes cord member 86 which is secured to pivot link member 80 at section 88. Cord 86 passes over a pair of pulley members 90. Pulley members 90 are mounted to horizontal bar 38 and are in a fixed securement thereto. Cord member 86 passes in a downward manner generally parallel to upper and lower tubular rod members 26 and 22 as is shown. Cord member 86 includes a plurality of cord hook members 92 upon which particular weight elements 66 may be mounted. In this version of the game, operators 12 place weight elements 66 on cord hook members 92 until the combined weight of weight elements 66 cause rotation of link member 80. This has the effect of releasing cover device 56' from rim portion 58 of container 42. At this time, liquid 44 from within container 42 douses operator 12.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described. Certain structures may be used independently of others, and in certain cases particular locations of elements may be reversed or interposed, all without departing from the spirit or the scope of the invention as defined in the appended claims.

What is claimed is:

1. A liquid game amusement system, comprising:

(a) a stand member adapted to be mounted on a base surface;

(b) container means releasably securable to said stand member, said container means forming a cavity adapted to contain a liquid inserted therein, and generally defining a substantially horizontal rim;

(c) cover means mounted to a rim portion of said container means in a manner such that said liquid is maintained within said container means by atmospheric pressure acting on a lower surface of said cover means, said cover means being positionally located in interfacing relation with said container means rim, and;

(d) weight means for applying a force to said cover means in an opposing direction to a force applied by said atmospheric pressure, said weight means being releasably securable to said cover means external said container means.

2. The liquid game amusement system as recited in claim 1 where said weight means includes a plurality of weight elements adapted to be secured to said cover means.

3. The liquid game amusement system as recited in claim 2 including:

(a) a gameboard member having a plurality of indicia zones formed thereon; and, (b) a spinner member rotatably secured to said gameboard member for indicating a predetermined indicia zone on said gameboard corresponding to a predetermined indicia formed on at least one of said weight elements to be secured to said cover means.

4. The liquid game amusement system as recited in claim 1 where said stand member includes:

(a) vertical extension means for maintaining said cover means at a predetermined vertical displacement above said base surface; and, (b) a horizontal bar member extending from said vertical expansion means in substantially orthogonal relation thereto, said container means being securable to said horizontal bar member.

5. The liquid game amusement system as recited in claim 4 where said stand member includes stand adjustment means on said vertical extension means for vertically adjusting said horizontal bar member above said base surface.

6. The liquid game amusement system as recited in claim 5 where said horizontal bar member includes a horizontal bar hook member secured to said horizontal bar for releaseable insert to a lug member secured to said container means.

7. The liquid game amusement system as recited in claim 1 where said cover means includes a plurality of cover hook members extending from a lower surface of said cover means and adapted to receive said weight means.

8. The liquid game amusement system as recited in claim 7 where each of said weight means includes an eyelet member adapted to be inserted on one of said cover hook members.

9. The liquid game amusement system as recited in claim 1 including weight securing means pivotally connected to said cover means and linearly displaceable with respect to said stand member.

10. The liquid game amusement system as recited in claim 9 where said weight securing means includes:

(a) a pivot link member secured to said cover means; and, (b) a cord member secured to said pivot link member, said cord member having a plurality of cord hook members for releaseable securement of said weight means thereto.

* * * * *